US005419592A

United States Patent [19]

Stuart

[11] Patent Number: 5,419,592

[45] Date of Patent: May 30, 1995

[54] BINGO-GAME MARKER WITH REVEALABLE, CONCEALED IMPRINT

[75] Inventor: Kenneth D. Stuart, Coral Springs, Fla.

[73] Assignee: Stuart Entertainment, Inc., Council Bluffs, Iowa

[21] Appl. No.: 70,188

[22] Filed: Jun. 2, 1993

[51] Int. Cl.[6] ..... B42D 15/00

[52] U.S. Cl. ..... 283/102; 283/100; 283/901; 283/903; 273/269; 40/334; D19/36; D18/14; 101/405

[58] Field of Search ..... 101/368, 333, 372, 405, 101/406; 273/269, 270; 283/903, 102, 901, 100, 101; D19/36; 40/334, 335; D21/42; D18/14, 15

[56] References Cited

U.S. PATENT DOCUMENTS

| | | | |
|---|---|---|---|
| D. 80,646 | 3/1930 | Thomas et al. | 40/334 X |
| D. 325,751 | 4/1992 | Futino | D21/51 |
| D. 326,118 | 5/1992 | Black | D21/51 |
| D. 334,399 | 3/1993 | Ziegler | D21/51 X |
| D. 345,376 | 3/1994 | Underwood, Jr. | D21/51 X |
| 986,675 | 3/1911 | Bennet | 40/334 |
| 1,830,102 | 11/1931 | Felsenthal | 40/334 |
| 2,067,466 | 1/1937 | Thomas | 40/334 X |
| 2,999,698 | 9/1961 | Hoese | 283/903 X |
| 4,174,857 | 11/1979 | Koza . | |
| 4,243,338 | 1/1981 | Williams | 40/334 X |
| 4,541,630 | 9/1985 | Dirks . | |
| 4,627,643 | 12/1986 | Leonetti et al. . | |
| 4,726,608 | 2/1988 | Walton . | |
| 4,935,401 | 6/1990 | Pendergrass, Jr. . | |
| 4,962,950 | 10/1990 | Champion . | |
| 5,286,061 | 2/1994 | Behm | 283/903 X |

FOREIGN PATENT DOCUMENTS

| | | | |
|---|---|---|---|
| 907689 | 3/1946 | France | 40/334 |
| 354344 | 8/1931 | United Kingdom | 40/334 |
| 466114 | 5/1937 | United Kingdom | 40/334 |

OTHER PUBLICATIONS

"Seal Card Games", Breakopens by Douglas Press 1987

Bingo King Catalog of Bingo, Carnival & Party Supplies, 1988–1989; pp. 18–9 & 69.

*Primary Examiner*—Frances Han

*Attorney, Agent, or Firm*—Millen, White, Zelano & Branigan

[57] ABSTRACT

A bingo-game marker comprises revealable, concealed imprints of symbols or indicia covered with an opaque coating which is removable to reveal imprints which provide a sweepstakes-play mechanism for enhancement of the attraction of the game and for promotional purposes.

6 Claims, 2 Drawing Sheets

BINGO-GAME MARKER WITH REVEALABLE, CONCEALED IMPRINT

This invention relates to bingo-game markers and, more particularly, to bingo markers (marking pens or bottles) having a medium therein for marking bingo cards.

Devices are known that combine game-playing devices with a writing instrument; for instance, U.S. Pat. No. 4,541,630 discloses a retractable ball-point pen that includes random number selectors to provide multiple game plays.

Devices, such as cards or tickets, that have revealable, concealed imprints upon surface areas for gaming purposes are also well known, particularly in the form of sweepstakes tickets, lottery tickets, and the like. Use for promotional purposes of such imprints, for example, upon admission tickets is also known. For example, Champion discloses in U.S. Pat. No. 4,962,950 apparatus for increasing attendance at parimutuel events, specifically an admission ticket including a wagering stub that includes a concealed wager covered by an opaque material which may be scratched from the ticket surface by, for example, use of an edge of a coin.

Different devices in the art for concealing and revealing imprints are, for example, described in U.S. Pat. Nos. 4,174,857; 4,627,643; 4,726,608; and, 4,935,401 which are incorporated herein by reference. In general, imprints of symbols or indicia are concealed by being covered with an opaque coating which is removable, for instance, by scratching-off with a coin or by various other means to reveal the imprint.

It is a feature of the present invention to provide revealable, concealed, imprinted symbols or indicia upon a surface of a game marker, for instance as purchased by players for use in bingo games to mark bingo cards. Purposes include enhancement of players' interest and gaming thrill, advertising and promotional purposes, and the like.

SUMMARY

In accordance with principles of the present invention, there is provided a bingo game marker including upon its surface revealable, concealed symbols or indicia for sweepstakes or lottery plays. When the indicia are uncovered, they are used as lottery entries or other game plays. A purpose of the structure of the invention is an increase in the sale of such markers. Another is the enhancement of attraction of the particular games requiring marking with the marker. Such game markers employed during the playing of bingo and other lotto-like games, for example, can offer the additional attraction of the opportunity of a sweepstake play.

An embodiment of a game marker according to principles of the invention comprises a marker bottle, a sealing cap, and imprinting either directly upon the surface of the bottle or upon labels that are affixed to the bottle. At least part of the imprinting is of a revealable, concealed type and providing at least one field having an opaque coating over the imprinting. The coating is removable (for example, by scratching-off with a coin) to reveal a symbol or indicium therebeneath. The sealing cap can be provided with imprinting and/or labelling as well. The bottle contains an appropriate marking medium such as ink or crayon and its neck opening can be provided with a conventional, controlled ink dispensing means, for instance, in form of conventional felt-tip or ball closure devices commonly employed in writing and marking instruments.

The game marker of this embodiment is employed in a conventional manner for ink-marking of game cards and/or fields thereof; for instance, as used in bingo and lotto-like games wherein numbers printed upon game cards are marked as the numbers are called and matched during a game. The game marker is intended to be purchaseable by a game player for such marking purposes and, additionally, the player is given the opportunity to win a prize by playing the sweepstake game that is facilitated by the revealable, concealed imprint upon the purchased bottle. For example, the player can win a prize by matching three symbols that may be uncovered after the opaque coating is scratched off in appropriate fields.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
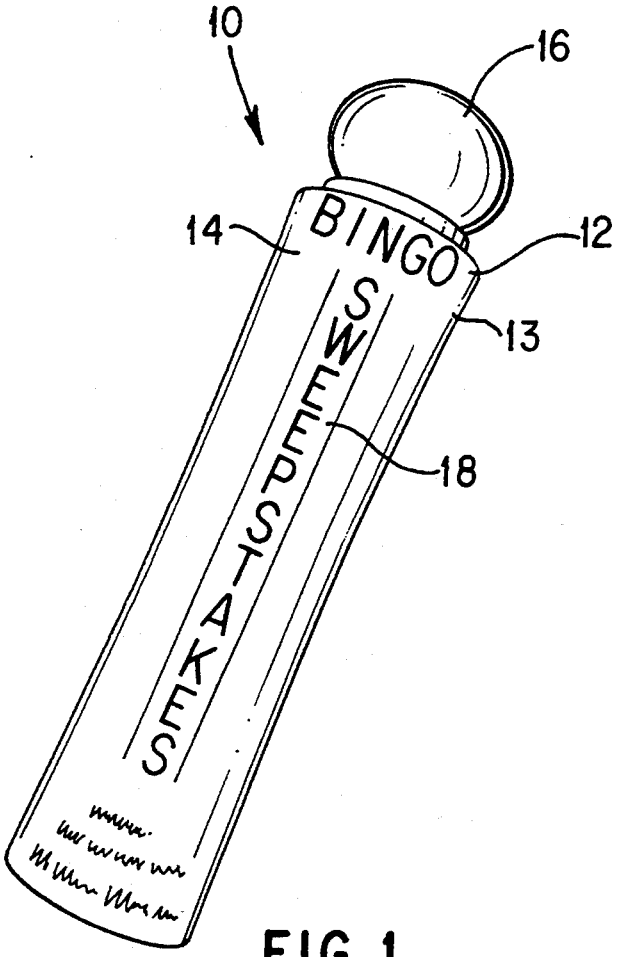
FIG. 1 is a schematic, perspective, front view of an embodiment of a game ink marker according to principles of this invention.

Referring now to FIGS. 1–4 of the drawings, there is depicted a game marker 10 such as a bingo-game ink marker. An enclosing body or bottle 12 has an outer surface 13; a printing area 14 on the surface of bottle 12; a marker cap 16 for closing off bottle 12; a sweepstakes legend 18; a sweepstakes facility 19; sweepstakes symbols 20, 20', and 20'' and concealed symbols 21 imprinted on outer surface 13 in area 14. A first removable opaque covering 22 is located over symbols 21. A second removable opaque covering 24 is located over imprinted indicia 26; and, also imprinted on the bottle are instructions 28 for playing the sweepstakes.

In another embodiment, imprinting, including the sweepstakes data, is disposed on a label 30 (indicated in FIGS. 3 and 4) which is affixed to the bottle 12.

Game markers are used in a variety of games, for instance in the game of bingo for marking of called numbers on bingo cards. Markers may use a liquid medium (ink) or, alternately, a solid marking medium, for instance of a crayon-like kind. Game markers are often purchased by players from the organizers of the game. The game marker 10 of the invention provides a sweepstakes play facility 19 in addition to its conventional marking function and purpose. The sweepstakes play facility 19 enhances the attraction for the game and for the purchase of a game marker.

In the instant game marker, the sweepstakes facility 19 includes various symbols [for example, 20 (FIG. 3) 20' and 20'' (FIG. 4) and 21 (FIG. 2)] imprinted in a revealably-concealed manner on surface 13 in the printing area 14 of the bottle 12 of marker 10. The symbols are concealed by a conventional, removable, opaque covering 22 that overlays the symbol imprints. The covering can be removed, for instance, by scratching off with a sharp-edged object (such as the edge of a coin). Other conventional coverings, as for example given by an opaque overlay of a releasable adhesive film, can be used; in which case removal may involve peeling off the covering.

Figure 2:
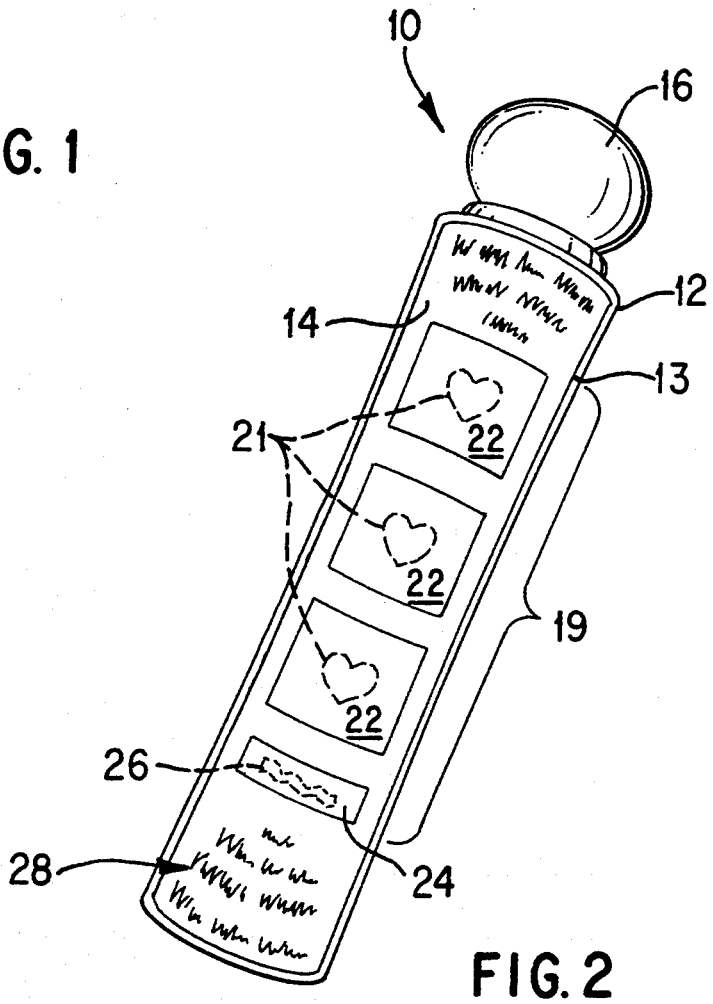
FIG. 2 is a schematic perspective back view of the game ink marker shown in FIG. 1; and, FIGS. 3 and 4 depict schematically-revealed imprint examples of symbols or indicia as can be employed in the embodiment shown in FIG.1.

The sweepstake facility 19 is shown in FIG. 2 to include three concealed symbols 21. Symbols may be of graphic, alphanumeric, pictorial, color, or other kind. Facility 19 can also include means for checking the possibility of tampering with or misuse of the sweepstakes in the form of concealed imprinted indicia 26 covered by a second removable opaque covering 24. Conventionally, the game is voided if covering 24 is removed from security indicia 26. Alternatively, the opaque covering 24 can be of the tamper-resistant scratch-off type as set forth in U.S. Pat. No. 4,726,608 which is incorporated herein by reference in its entirety.

Conventional imprinting of the symbols (and indicia) may be directly on the surface of the bottle 12, provided that the bottle material and the printing medium are compatible to permit adequate imprint quality and permanency. Alternately, an intermediate layer of an appropriate material or an appropriate surface treatment can be provided to permit imprinting and to assure imprintability. As a still further alternative, an adhesive label 30 (FIG. 4) appropriately imprinted and affixed to surface 13 of bottle 12 can serve as the intermediate material for the various imprinting of the sweepstakes facility 19 (and other imprinting).

In regard to imprintings and opaque coverings (22, 24) thereover, examples of some conventionally-employed, revealable imprinting and thereover-applied, concealing, opaque-coating materials and methods are, for instance, described in said U.S. Pat. No. 4,726,608.

Figure 3:
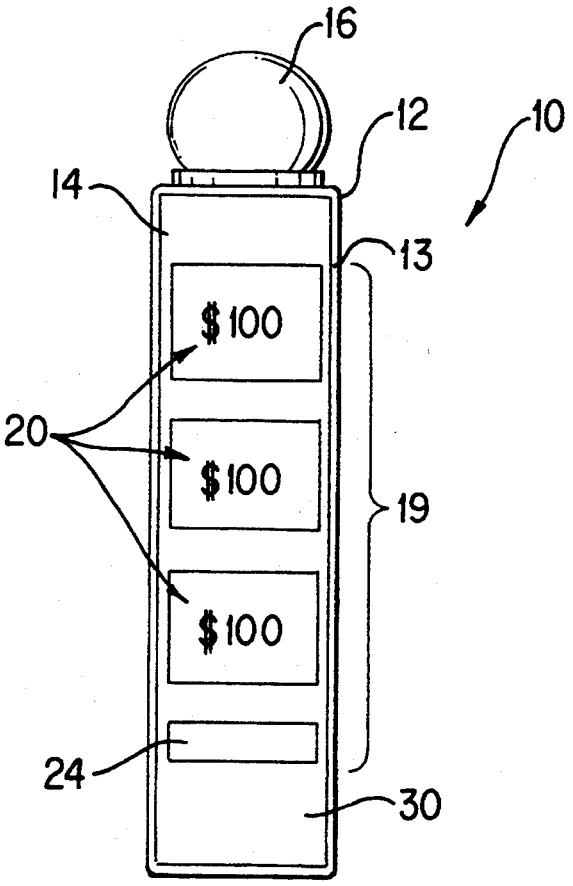
Figure 4:
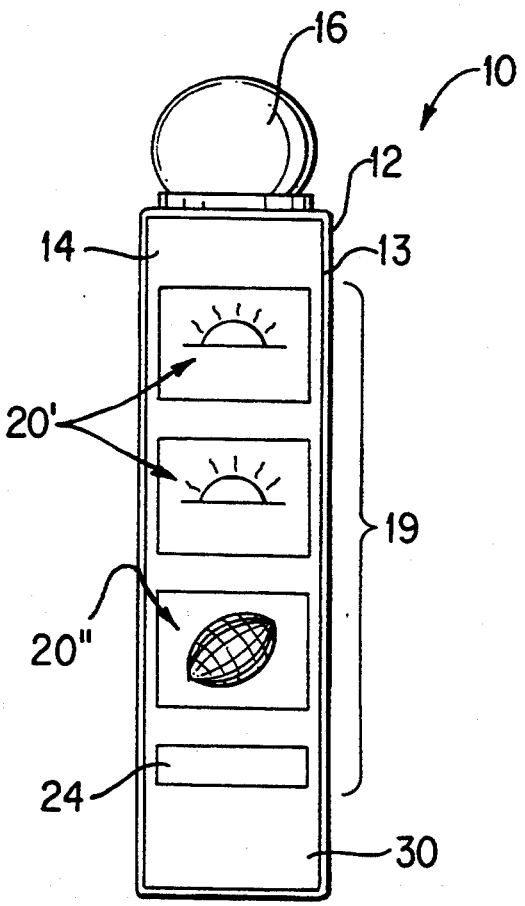

In use of the sweepstakes play facility of the above-described game marker, the purchaser (or user) of the marker removes some or all of the first coverings 22 (over the symbols) and establishes whether the marker contains any matching symbols identifying a win according to the rules and instructions of play. Symbols (particularly of a winning match) can also include identification of the prize won. FIG. 3, for example, shows a match of three "$100" symbols indicating that $100 has been won.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A game marker for playing a game, said game marker comprising;

means for holding and issuing marking medium including an enclosing body, said enclosing body including means for permitting imprinting thereon and having an outer surface;

a sweepstakes facility including at least one sweepstakes symbol imprinted on said outer surface; and, a first covering that is opaque said first covering overlaying and concealing said symbol, but being removable to reveal said symbol; and, means for checking misuse of said sweepstakes facility, said means for checking including indicia imprinted on said outer surface, said means for checking further including a second covering overlaying and concealing said indicia and selectively removable to reveal said indicia.

2. In a bingo-game marker having an outer surface, the improvement comprising:

a sweepstakes-playing facility having at least one symbol, imprinted upon said outer surface of said marker, said at least one symbol having an opaque covering for concealing said at least one symbol, said opaque covering being removable by scratching off said opaque covering to reveal said at least one symbol.

3. A combination of a game marker for a game and a sweepstakes-playing facility to enhance the attraction for said game and for acquisition of said game marker, the combination comprising:

means for indicating a sweepstakes win, said means for indicating including revealable, concealed imprints upon said game marker;

said imprints being concealed by an opaque covering overlaid on said imprints; and, wherein said concealed imprints are revealed by scratching off said opaque covering.

4. A game marker for playing a game, said game marker comprising:

means for holding and issuing marking medium including an enclosing body, said enclosing body including means for permitting imprinting thereon and having an outer surface;

a sweepstakes facility including at least one sweepstakes symbol imprinted on said outer surface;

a first opaque covering overlaying and concealing said symbol; and, wherein said first covering is permanently removable to reveal said symbol.

5. In a bingo-game ink marker, having an outer surface, the improvement comprising:

a sweepstakes-playing facility having at least one symbol imprinted upon said outer surface of said marker, said at least one symbol having an opaque covering for concealing said at least one symbol; wherein said opaque covering is permanently removable to reveal said at least one symbol.

6. A combination of a game marker for a game and a sweepstakes-playing facility to enhance the attraction for said game and for acquisition of said game marker, the combination comprising:

means for indicating a sweepstakes win, said means for indicating including revealable, concealed imprints upon said game marker; and, a permanently removable opaque covering for concealing said imprints wherein said imprints are revealed by removal of said covering.

* * * * *